US007971763B2

(12) United States Patent
Chace

(10) Patent No.: US 7,971,763 B2
(45) Date of Patent: Jul. 5, 2011

(54) BACKPACK-STYLE STRAP CARRIER TOTE

(76) Inventor: Susan Lee Chace, Seattle, WA (US)

( * ) Notice: Subject to any disclaimer, the term of this patent is extended or adjusted under 35 U.S.C. 154(b) by 467 days.

(21) Appl. No.: 12/122,415

(22) Filed: May 16, 2008

(65) Prior Publication Data

US 2008/0283566 A1 Nov. 20, 2008

Related U.S. Application Data

(60) Provisional application No. 60/930,793, filed on May 17, 2007.

(51) Int. Cl.
*A45F 3/14* (2006.01)
*A45F 4/02* (2006.01)
*A45F 3/04* (2006.01)

(52) U.S. Cl. ..... 224/259; 224/250; 224/153; 224/627

(58) Field of Classification Search ..... 224/257, 224/250, 251, 153, 259, 149, 150, 602, 627, 224/913, 916
See application file for complete search history.

(56) References Cited

U.S. PATENT DOCUMENTS 995,458 A * 6/1911 Harriman ..... 224/651
2,715,989 A * 8/1955 Sjodin et al. ..... 224/624
4,911,347 A * 3/1990 Wilhite ..... 224/257
D311,813 S * 11/1990 Oliver ..... D3/216
5,437,401 A * 8/1995 Seltzer ..... 224/578
5,490,806 A 2/1996 Spector
5,664,721 A * 9/1997 Homeyer ..... 224/651
D389,642 S 1/1998 Nadel
6,491,196 B1 12/2002 Coler
6,751,816 B1 6/2004 Wechsler
6,889,882 B1 * 5/2005 Leep ..... 224/579
7,007,322 B2 3/2006 Alane
D530,512 S 10/2006 Palaszek
2004/0250346 A1 12/2004 Vasishth
2005/0172402 A1 8/2005 Uretzky-Miller
2006/0043135 A1 3/2006 Lindsey
2006/0160672 A1 7/2006 Appleby
2006/0246817 A1 * 11/2006 Orlowski ..... 446/236

* cited by examiner

*Primary Examiner* — Justin M Larson
*Assistant Examiner* — Lester L Vanterpool
(74) *Attorney, Agent, or Firm* — Polly L. Oliver

(57) ABSTRACT

A unique strap carrier tote carries a rolled yoga mat, collapsed hula hoop, towel, prayer rug, poster/drawing case, or other piece of equipment in a backpack style on the user's back. Two adjustable straps encircle the piece of equipment—typically proximate opposing ends of the rolled mat or opposing sectional sides of the collapsed hoop—and two adjustable shoulder straps extend therefrom. The user can sling the piece of equipment across her back so that her hands will be free, and the equipment will be securely and easily carried during walking, running, climbing, biking, etc.

2 Claims, 9 Drawing Sheets

BACKPACK-STYLE STRAP CARRIER TOTE

RELATED APPLICATIONS

This application is related to and claims priority under 35 U.S.C. 119(e) to U.S. provisional application Ser. No. 60/930,793, entitled "Yoga Tote," filed on May 17, 2007 with inventor Susan Chace of Seattle, Wash., which is hereby incorporated by reference in its entirety.

FIELD OF THE INVENTION

This invention pertains generally to exercise accessories and more particularly to a backpack style strap carrier tote for exercise equipment such as rolled yoga mats and collapsed hula hoops.

BACKGROUND OF THE FIELD

Today, more and more people are practicing yoga, hooping, and outdoor praying as a lifestyle choice and a form of exercise and/or communing with nature. Because these activities are often practiced away from home, it is necessary for a user to have a way of carrying her equipment (mat, hoop, towel, etc.) from place to place. There are currently several totes on the market for carrying yoga mats. Most of them are configured so that the user can sling the mat over her shoulder like a purse, and a few of them are configured so that the user can wear them across her back with the strap diagonally across her chest. Both of these styles are limited in the security they offer, and restrict the user's movement.

For instance, U.S. Patent Application Publication No. 2006/0043135 to Lindsey discloses an exercise bag that can hold a rolled up yoga mat on the user's back in a backpack style. However, Lindsey's device comprises cross-over straps and also includes a large bag for clothing and other equipment as well as the yoga mat. U.S. Pat. No. 7,007,322 B2 to Alane discloses a rolled up yoga mat with two integral encircling straps on the ends. However, Alane's device has only one carrying strap, and it is a hand strap, not a shoulder strap. Therefore, Alane's device must be carried in the user's hand, not on her back, and the user's hands will not be free—limiting the use of the device. U.S. Pat. No. 6,491,196 B1 to Coler discloses a sling-style backpack unit for a rolled yoga mat. However, Coler's device includes only one shoulder strap and so is not intended to be worn in a backpack-style.

SUMMARY OF THE INVENTION

The present invention solves the above-mentioned problems by providing a strap carrier tote that is in a backpack style that allows the user to sling a piece of exercise or other equipment—such as a yoga mat, collapsible hula hoop, blanket, towel, prayer mat, or other—on her back with two shoulder straps securing the item thereon. The user is then free to use her hands, and she can then easily carry her strap carrier tote from one place to another while running, walking, climbing, biking, etc.

One embodiment of the invention comprises a strap spine (intended to generally parallel a portion of the user's spine while carried) having a first, top end and a second, bottom end. Each end has an intersection where the shoulder straps attach to the strap spine in a "V" pattern. Each intersection also includes equipment straps designed to hold the piece of exercise equipment. Such equipment straps can be specifically designed for an elongated item (such as a rolled yoga mat, towel, or drawing case), or a disc-shaped item (such as a collapsed hula hoop), or other shape of item.

BRIEF DESCRIPTION OF THE DRAWINGS

The objects, features, and advantages of the present invention will be apparent to one skilled in the art from reading the following description in which.

DETAILED DESCRIPTION

The following specification describes a strap carrier tote apparatus. In the description, specific materials and configurations are set forth in order to provide a more complete understanding of the present invention. But it is understood by those skilled in the art that the present invention can be practiced without those specific details. In some instances, well-known elements are not described precisely so as not to obscure the invention.

Figure 1:
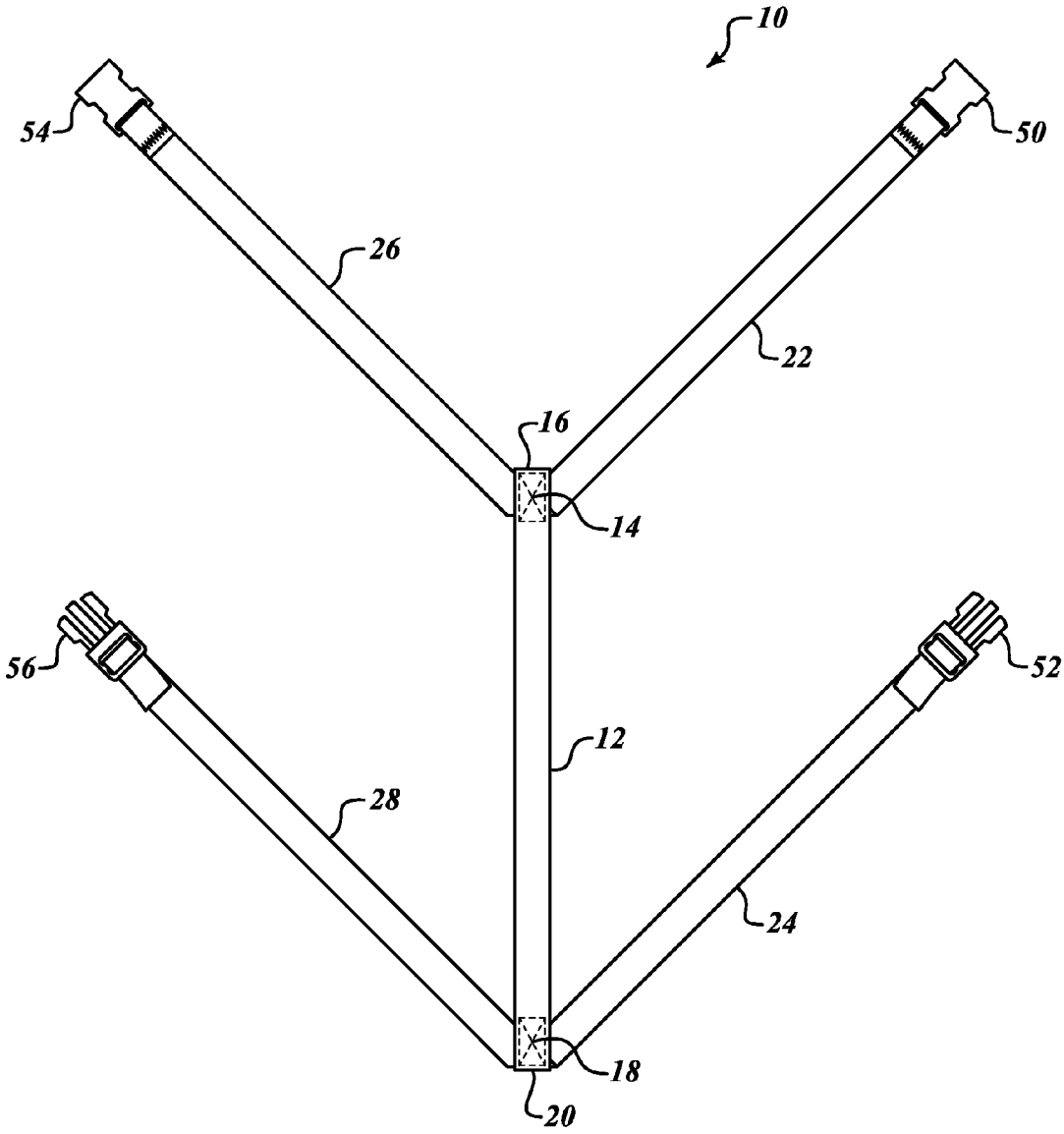
FIG. 1 is a top view of a preferred embodiment of the strap carrier tote showing how the shoulder straps are attached in a "V" shape.

FIG. 1 shows a generic backpack-style strap carrier tote 10 according to the preferred embodiment as it is to be laid out on a generally flat surface. This embodiment comprises a strap spine 12, typically made from a length of nylon webbing or canvas ribbon, with a top intersection 14 proximate a first end 16 and a bottom intersection 18 proximate a second end 20. The intersections may be reinforced, e.g., by heavy-duty sewing.

Figure 3:
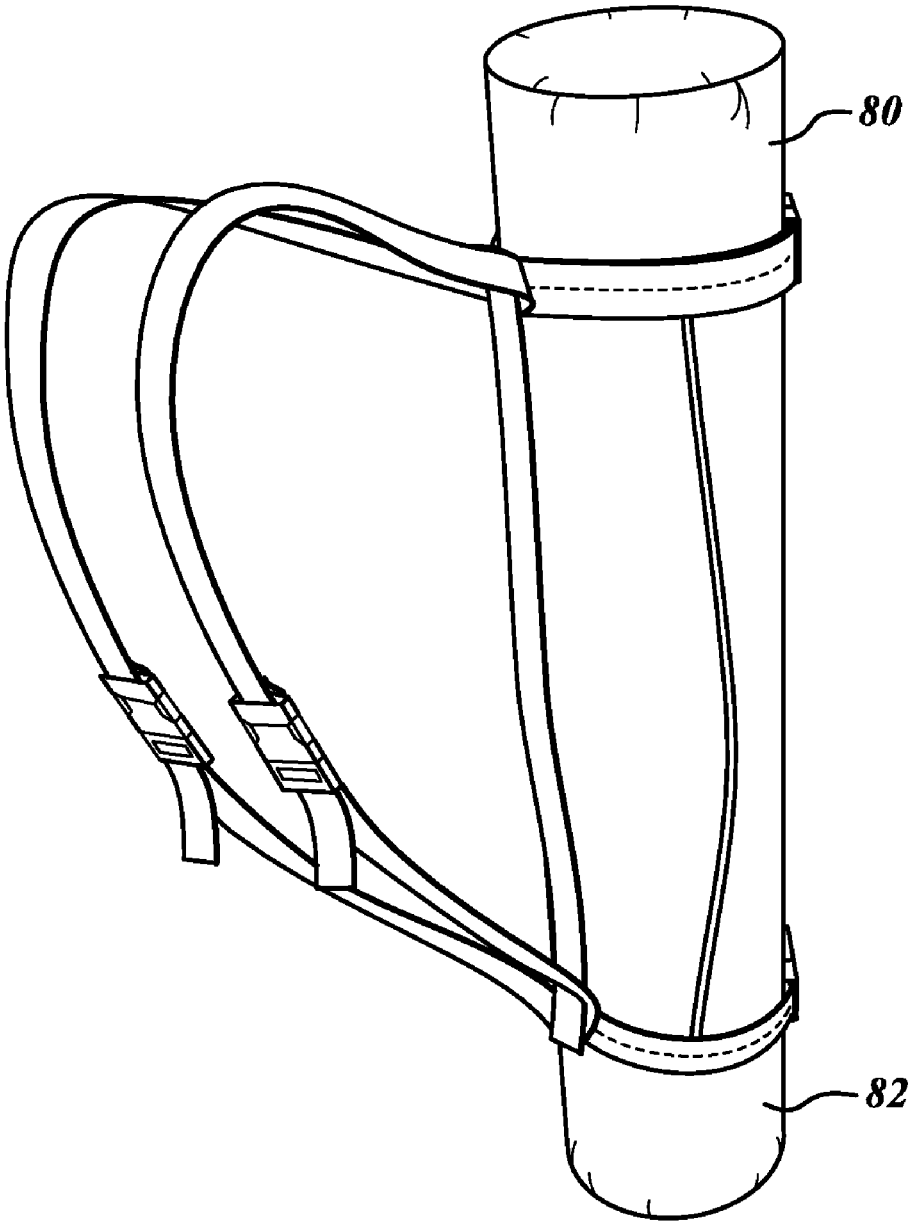
FIG. 3 is a perspective view of the carrier strapped around a rolled yoga mat.

The shoulder straps are attached to the intersections in "V" shapes (the top portions to the top intersection and the bottom portions to the bottom intersection respectively). The "V" shapes may have included angles of any appropriate value; however, it has been found that an included angle in the range of 40 to 90 degrees may be optimal. The left shoulder strap may be made as one continuous strap extending from top intersection to bottom intersection or may comprise a top portion 22 attached to the top intersection 14 and a bottom portion 24 attached to the bottom intersection 18. The right shoulder strap may be made as one continuous strap extending from top intersection to bottom intersection or may comprise a top portion 26 attached to the top intersection 14 and a bottom portion 28 attached to the bottom intersection 18. The strap carrier tote 10 may also comprise various buckles linked to strategic locations of said shoulder straps—such as proximate the ends of the shoulder strap portions—to make the invention more adjustable to individual users. In this embodiment, the top portions of the shoulder straps, 22 and 26, are linked to the female portions of the buckles 50 and 54 respectively, and the bottom portions 24 and 28 are linked to the male portions of the buckles 52 and 56 respectively. With this type of buckle, generally the female portions 50 and 54 are fixed to the ends of the straps 22 and 26, and the male portions 52 and 56 are linked adjustably to the ends of the straps 24 and 28. (FIG. 3 shows how these buckles may cooperate within the invention.)

Figure 2:
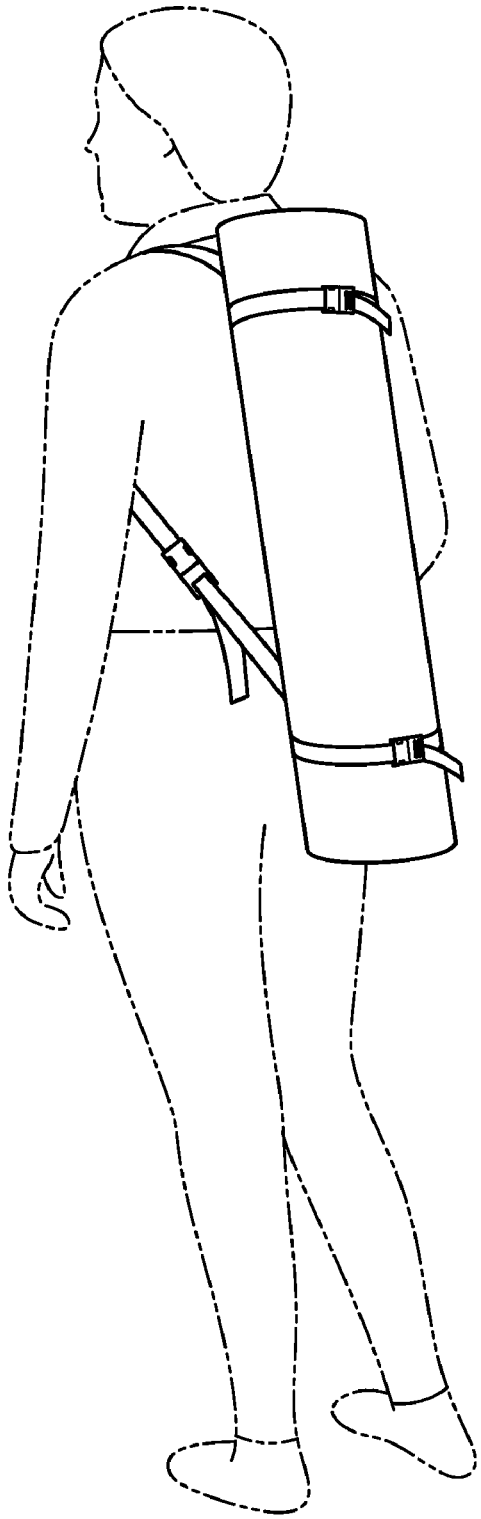
FIG. 2 is a perspective view of the carrier with a rolled yoga mat as it may be carried on a user's back.

FIG. 2 shows one species embodiment of the strap carrier tote designed for use with an elongated piece of equipment, such as a rolled yoga mat, exercise mat, sleeping bag, camera tripod, plastic drawing case, etc. As can be seen from the figure, the buckles of the shoulder straps can be located—and the lengths of the respective shoulder strap portions respectively proportioned—low on the strap and behind the user's arm. This position of the buckles may offer a greater degree of comfort to the user. Likewise, the included angle of the "V" shape may be varied to accommodate taller or shorter users.

For this elongated type of equipment, there will probably need to be equipment straps at the top and bottom designed to securely hold the piece of equipment, probably attached at the respective intersections for strength. FIG. 3 shows how the equipment item will be held by such equipment straps, and FIG. 2 shows how the equipment strap buckles may be positioned to fasten on the back of the equipment being carried. FIG. 3 also shows how the straps may be attached to the top and bottom intersections and how the top and bottom intersections may be placed along the strap spine in acceptable locations so that the spine will be stretched out to its full extent along the user's back. Because the strap spine itself is flexible, gravity and the elongated shape of the piece of equipment will work together to keep the strap spine stretched out and the intersections spaced apart.

Alternatively, end caps 80 and/or 82 can be added to the top and bottom to further secure the item being carried. In the embodiment shown, there are end caps on both top and bottom; however, the invention could be designed with, and may work just as well with, only the bottom end cap—particularly used to hold a wider range of items to be carried, such as a smooth plastic tubular case for drawings, posters, etc. In the embodiment shown, the end caps 80 and 82 are made from a thin flexible material such as nylon, but in alternate embodiments could be a hard plastic or other rigid material. The end caps may be attached to the equipment straps permanently, such as by the sewing of the illustration, or temporarily, such as by snaps, zippers, or Velcro™. Furthermore, the end cap may have an opening 84 to facilitate the insertion of the item to be carried. In this case, the opening is simply a material overlap, but in alternate embodiments, it could be accomplished with snaps, zippers, Velcro™, or the like.

Figure 4:
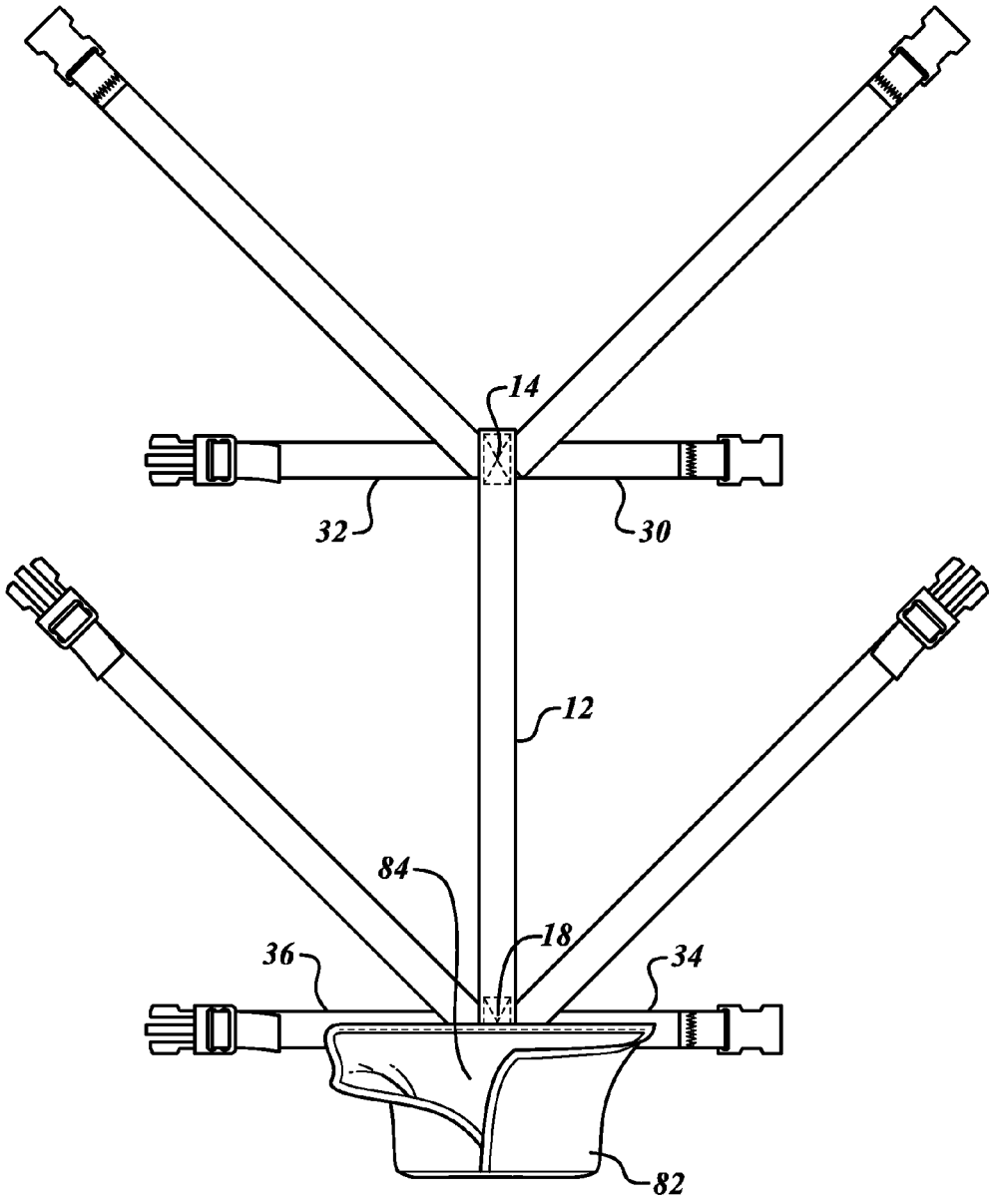
FIG. 4 is a top view of an embodiment of a yoga tote.

FIG. 4 shows the yoga mat tote embodiment laid out on a generally flat surface. As can be seen from the figure, because the equipment straps are intended to gird a generally tubular item, they are affixed at the intersections (top straps to top intersection and bottom straps to bottom intersection respectively) generally in a cross pattern relative to the strap spine 12. The top equipment strap may be made as one continuous strap looping from the top intersection back to the top intersection or may comprise a left portion 30 attached to the top intersection 14 and a right portion 32 attached to the top intersection 14. The bottom equipment strap may be made as one continuous strap looping from the bottom intersection back to the bottom intersection or may comprise a left portion 34 attached to the bottom intersection 18 and a right portion 36 attached to the bottom intersection 18. The equipment straps may also comprise various buckles linked to said equipment straps at strategic locations—such as proximate the ends of the equipment strap portions—to make the invention more adjustable to different items of equipment. In this embodiment, the male/female type of buckles are illustrated, but other types of buckles or appropriate fasteners could be used.

Figure 5:
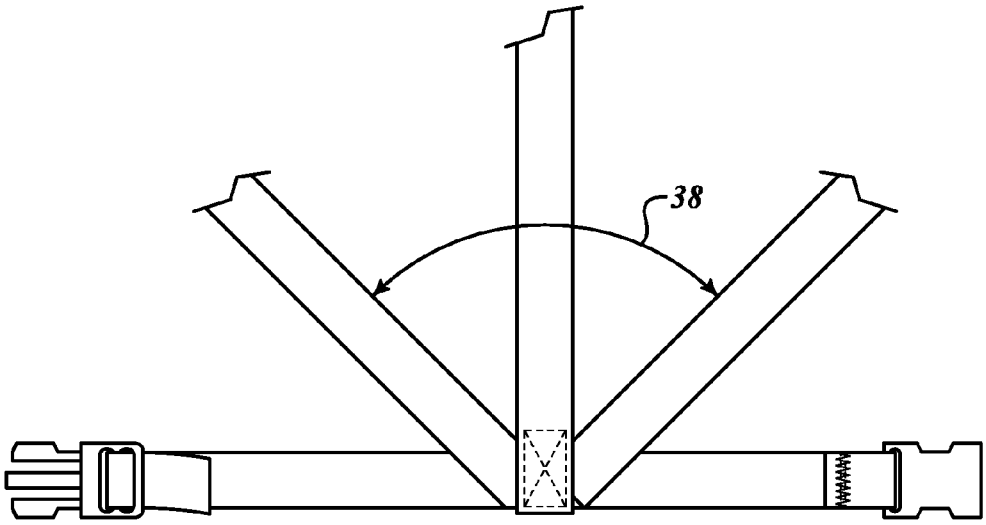
FIG. 5 is a detail view of an end intersection.

FIG. 5 simply shows in detail the bottom intersection 18 of the yoga tote embodiment of the strap carrier tote with buckles at the ends of the equipment strap portions. The intersection 18 may be reinforced by heavy-duty sewing or with additional material or in any other appropriate manner. In this illustration, the "V" shape is shown at a generally 90 degree included angle 38; however, the included angle may vary in different designs—to accommodate different equipment styles or different users.

To use the strap carrier to carry an elongated piece of equipment such as a rolled yoga mat, the user lays out the strap carrier so that the equipment straps are accessible (probably on a generally flat surface). Next, or prior to that step, the user prepares the equipment by rolling up the mat, folding the tripod, sliding into the case, or whatever is applicable, and aligns said prepared piece with the strap spine. Next, the user secures the equipment straps around the piece of equipment, perhaps by fastening and/or adjusting the buckles of the equipment straps. Once the equipment is secure, the user can mount the carrier tote on the user's back by securing the shoulder straps around the user's shoulders, perhaps by fastening and/or adjusting the buckles of the shoulder straps.

Figure 6:
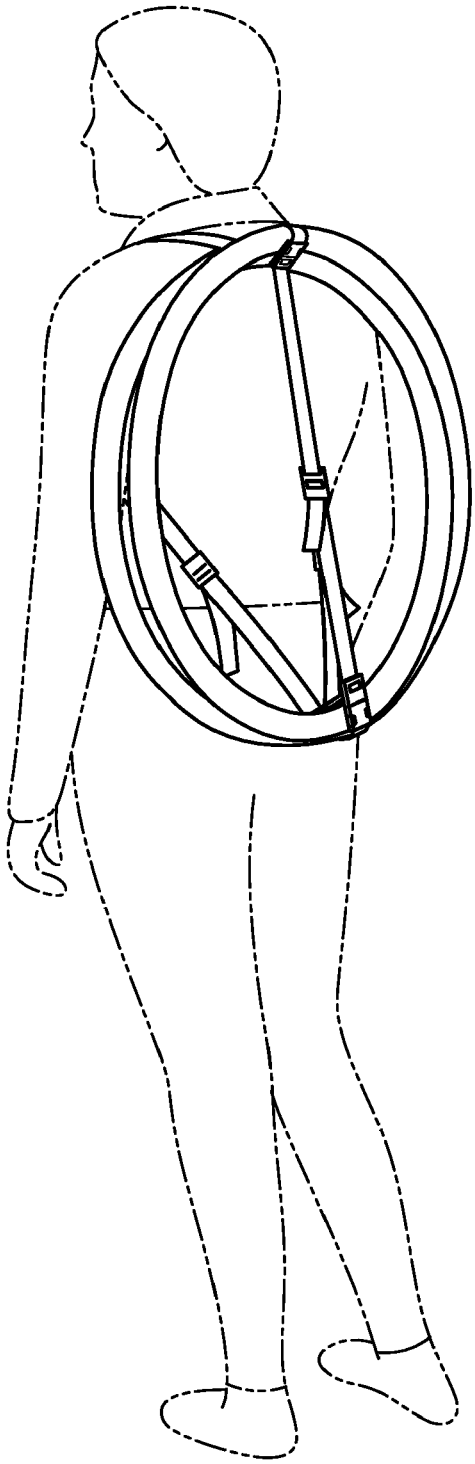
FIG. 6 is a perspective view of a carrier with a collapsed hula hoop as it may be carried on a user's back.

FIG. 6 shows another species embodiment of the strap carrier tote designed for use with a collapsed hula hoop or other toric-shaped or disc-shaped piece of exercise equipment, such as a snow saucer or other. As can be seen from the figure, the buckles of the shoulder straps can be located—and the lengths of the respective shoulder strap portions respectively proportioned—low on the strap and behind the user's arm—similar to the previous embodiment. In this embodiment, the strap spine of the carrier tote can also be made adjustable with the addition of a central buckle or other appropriate element.

Figure 7:
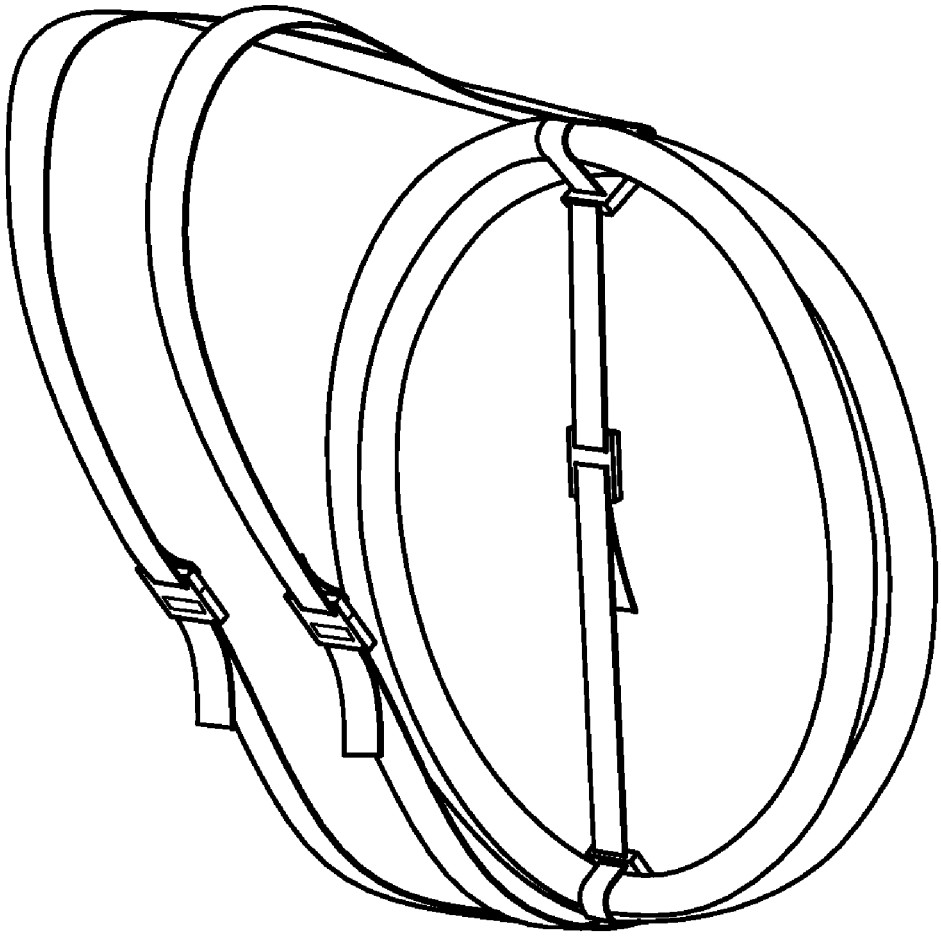
FIG. 7 is a perspective view of the carrier strapped around a collapsed hula hoop.
Figure 8:
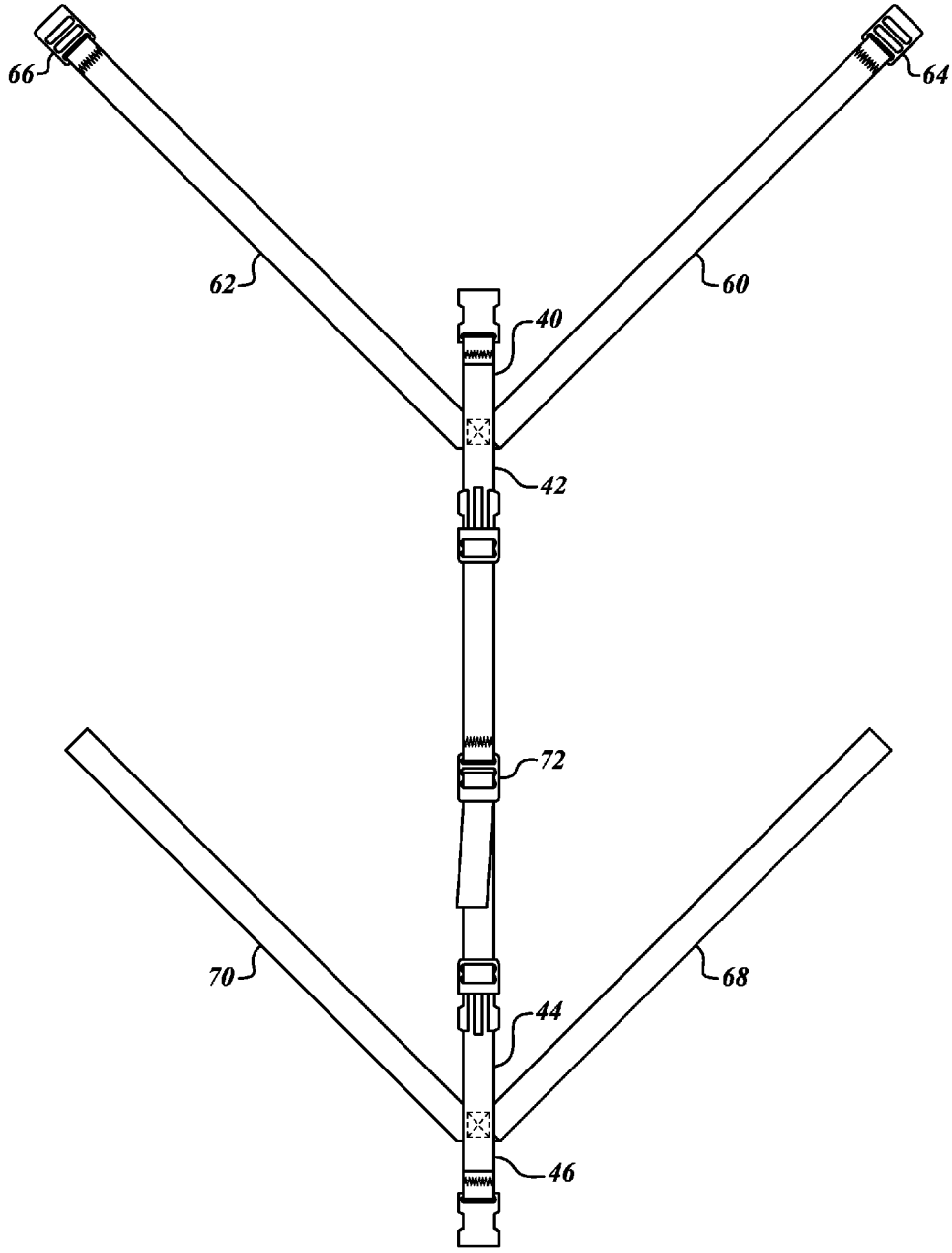
FIG. 8 is a top view of an embodiment of a hoop tote.

For this toric-shaped type of equipment, there will probably need to be equipment straps at the top and bottom designed to securely hold the piece of equipment. FIG. 7 shows how the equipment item will be held by such equipment straps, and FIG. 6 shows how the equipment strap buckles may be positioned to fasten on the back of the equipment being carried. FIG. 8 shows how the straps may be attached to the top and bottom intersections and how the strap spine itself is made adjustable with a central buckle, which will typically be buckled in tension during use. In this embodiment, the shape of the equipment item itself will keep the intersections and the equipment straps spaced apart.

FIG. 8 further shows the hoop tote embodiment laid out on a generally flat surface. Because the equipment straps are intended to gird sections of the hoop itself, said sections of which are being held generally in a cross pattern relative to the strap spine, the equipment straps are attached to the intersections (top straps to top intersection and bottom straps to bottom intersection respectively) in generally straight-line patterns. Obviously, it may be best to manufacture the equipment straps integrally with the strap spine. This could be accomplished, as in the embodiment shown, by simply mounting one buckle portion of the equipment strap on the spine itself and elongating the spine beyond the intersection to accommodate the opposing buckle portion. Alternately, the equipment straps could be made from a different material and attached at the intersections by heavy-duty sewing, application of adhesive, or some other applicable method. The top equipment strap may be made as one continuous strap looping from the top intersection back to the top intersection or may comprise an upper portion 40 attached to the top intersection 14 and a lower portion 42 attached to the top intersection 14 (which may be coincident with the strap spine itself). The bottom equipment strap may be made as one continuous strap looping from the bottom intersection back to the bottom intersection or may comprise an upper portion 44 attached to the bottom intersection 18 (which may be coincident with the strap spine itself) and a lower portion 46 attached to the bottom intersection 18. The equipment straps may also comprise various buckles at strategic locations—such as proximate the ends of the equipment strap portions—to make the invention more adjustable to different items of equipment. In the case that the equipment straps are coincident with the strap spine, these buckles may be affixed directly to the strap spine at the appropriate locations.

Also shown in FIG. 8 is an alternate type of buckle for the shoulder straps. In this alternate embodiment, both of the top portions (right and left) of the shoulder straps 60 and 62 have buckles 64 and 66 at the ends, and the lower portions of the shoulder straps 68 and 70 simply thread into the buckles as shown in FIG. 7. The distal ends of the straps 68 and 70 may be reinforced after they are threaded through the buckles so that they won't pull out—such as by doubling the material, adding heavy-duty sewing, attaching a small end cap, etc. In both of the illustrated buckle embodiments, the adjusting strap is on the lower portion so that a user can easily lengthen or shorten the shoulder straps while wearing the invention on her back. FIG. 8 also shows the central adjusting buckle 72.

Figure 9:
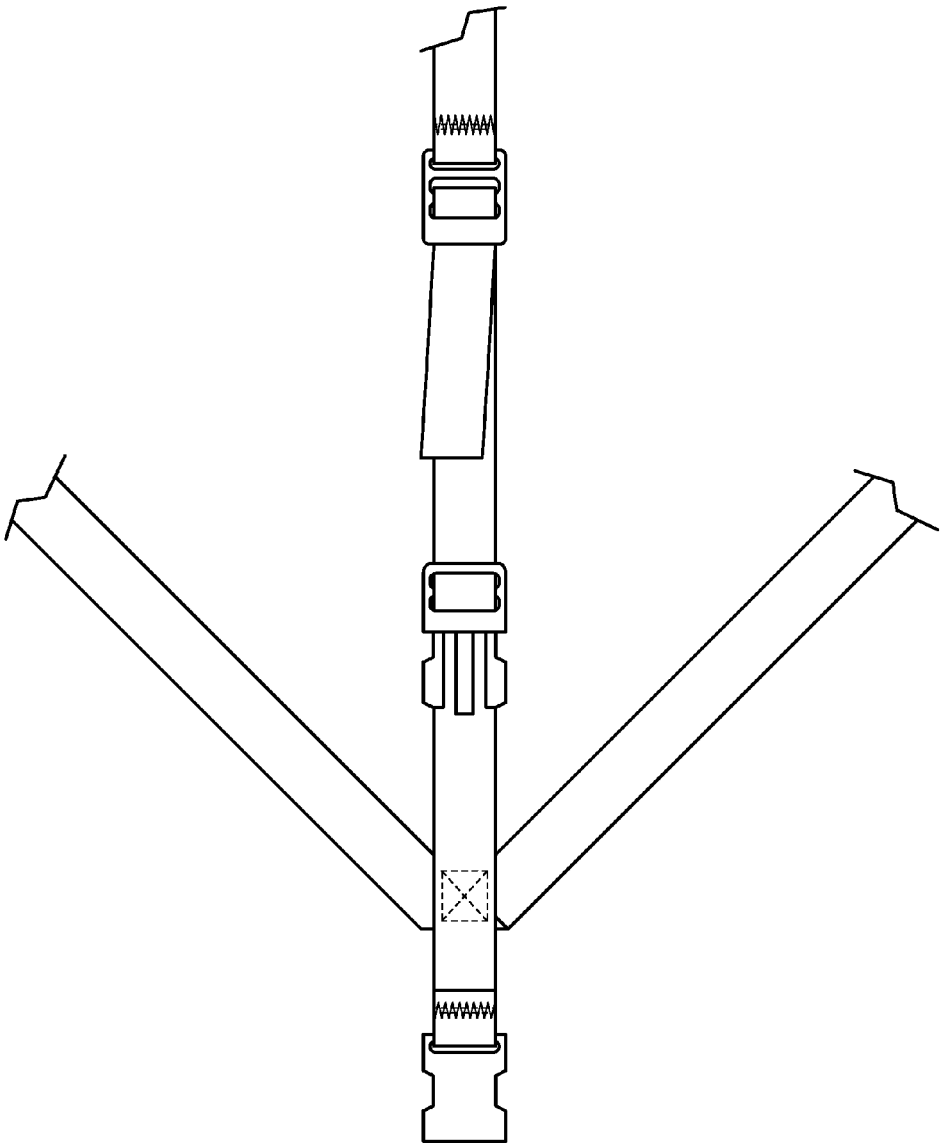
FIG. 9 is a detail view of an end intersection.

FIG. 9 simply shows in detail the bottom intersection 18 of the hoop tote embodiment of the strap carrier tote with buckles at the ends of the equipment strap portions. The intersection 18 may be reinforced by heavy-duty sewing or with additional material or adhesive or in any other appropriate manner. It is also shown in this figure how the strap spine may be provided in two portions and the central adjustable buckle may be applied. In this illustration, the "V" shape is shown at a generally 90 degree included angle; however, the included angle may vary in different designs—to accommodate different equipment styles or different users.

To use the strap carrier to carry a toric- or disc-shaped piece of equipment such as a collapsed hula hoop, the user lays out the strap carrier so that the equipment straps are accessible (probably on a generally flat surface). Next, or prior to that step, the user prepares the equipment by collapsing the hula hoop into a compact size of small diameter, or whatever is applicable, and aligns said prepared piece with the strap

What is claimed is:

1. A method for carrying a hula hoop on a user's back using a strap carrier having a strap spine, two shoulder straps linked thereto in a "V" shape and comprising adjustable buckles, and two equipment straps linked in a straight-line relative thereto and comprising adjustable buckles, said method comprising the steps of:

laying out the strap carrier on a generally flat surface;

preparing said hula hoop by collapsing said hula hoop into a compact size of small diameter and aligning said prepared hula hoop with said strap spine of said strap carrier;

securing said equipment straps around said collapsed hula hoop by fastening and adjusting said buckles around said collapsed hula hoop; and mounting said carrier on the user's back by securing said shoulder straps around said user's shoulders.

2. A method for carrying a hula hoop on a user's back using a strap carrier having a strap spine with a central adjusting buckle, two shoulder straps linked thereto in a "V" shape and comprising adjustable buckles, and two equipment straps linked in a straight-line relative thereto and comprising adjustable buckles, said method comprising the steps of:

laying out the strap carrier on a generally flat surface;

preparing said hula hoop by collapsing said hula hoop into a compact size of small diameter and aligning said prepared hula hoop with said strap spine of said strap carrier;

securing said equipment straps around said collapsed hula hoop by fastening and adjusting said strap buckles around said collapsed hula hoop and tightening said strap spine by adjusting said central buckle; and mounting said carrier on the user's back by securing said shoulder straps around said user's shoulders.

* * * * *